US005635659A

United States Patent [19]

Miyamoto

[11] Patent Number: 5,635,659

[45] Date of Patent: Jun. 3, 1997

[54] AUTOMATIC RHYTHM PERFORMING APPARATUS WITH AN ENHANCED MUSICAL EFFECT ADDING DEVICE

[75] Inventor: Hiromu Miyamoto, Hamamatsu, Japan

[73] Assignee: Yamaha Corporation, Hamamatsu, Japan

[21] Appl. No.: 401,866

[22] Filed: Mar. 10, 1995

[30] Foreign Application Priority Data

Mar. 15, 1994 [JP] Japan ..... 6-071383

[51] Int. Cl.[6] ..... G10H 1/40

[52] U.S. Cl. ..... 84/635; 84/DIG. 12

[58] Field of Search ..... 84/609–614, 634–638, 84/DIG. 12

[56] References Cited

U.S. PATENT DOCUMENTS

| | | | |
|---|---|---|---|
| 4,708,046 | 11/1987 | Kozuki | 84/DIG. 12 |
| 4,969,384 | 11/1990 | Kawasaki et al. | 84/612 |
| 5,220,119 | 6/1993 | Shimada | 84/609 |

FOREIGN PATENT DOCUMENTS

| | | |
|---|---|---|
| 5-73036 | 5/1991 | Japan . |
| 5-31680 | 8/1993 | Japan . |

*Primary Examiner*—Stanley J. Witkowski
*Attorney, Agent, or Firm*—Loeb & Loeb LLP

[57] ABSTRACT

An automatic rhythm performance apparatus includes an effect addition device which adds a substantial musical effect to the automatic rhythm performance. The automatic rhythm performance apparatus includes a memory device for storing automatic rhythm performance data including a plurality of event data, a reading device for reading out the automatic rhythm performing data from the memory device, a detecting device for detecting a predetermined first event data at a predetermined performance progression timing which is associated with the automatic rhythm performing data read out from the memory device, and an adding device for adding a predetermined second event data to the automatic rhythm performing data. The apparatus provides an automatic rhythm performance with newly added performance data, such that substantial musical effect is added to the automatic rhythm performance.

36 Claims, 8 Drawing Sheets

( TYPE = 0 )

( TYPE = 1 )

( TYPE = 2 )

AUTOMATIC RHYTHM PERFORMING APPARATUS WITH AN ENHANCED MUSICAL EFFECT ADDING DEVICE

BACKGROUND OF THE INVENTION

1. Field of the Invention

The present invention relates to an automatic rhythm performing apparatus in an electronic musical instrument, and in particular embodiments to an automatic rhythm performing apparatus which is capable of adding an enhanced musical effect to an automatic rhythm performance.

2. Description of Related Art

There have been a variety of automatic performing apparatuses capable of adding a musical effect to an automatically performed sound. For example, Japanese laid-open patent application HEI 5-73036 describes one such automatic performing apparatus, in which sound effect patterns for accents, sound generating timing, etc. are stored in a memory, and the stored sound effect patterns are read out for modifying a pattern in original performance data. The tone amplitude and tone generation timing of the original performance data are modified based upon the sound effect patterns to add a musical effect to the original performance. However, in such an automatic performing apparatus, only a part of the original performance data is modified to a small extent. As a result, only a small degree of musical effect can be added, and thus it does not give an impression that the original performance has been noticeably modified.

SUMMARY OF THE INVENTION

It is an object of embodiments of the present invention to provide an automatic rhythm performing apparatus that obviates the above mentioned limitations of the prior art technology.

Embodiments of the present invention provide an automatic rhythm performing apparatus which is capable of adding a substantial musical effect to an automatic rhythm performance.

An automatic rhythm performance apparatus, in accordance with one embodiment of the present invention, includes a memory device, a reading device, a detecting device and an adding device. The memory device is provided for storing automatic rhythm performance data including event data. The reading device reads out the automatic rhythm performance data from the memory device. The detecting device detects a predetermined first event data at a predetermined performance progression timing that is associated with the automatic rhythm performing data read out from the memory device. Also, the adding device is responsive to the detecting device for adding predetermined second event data to the automatic rhythm performance data.

In a preferred embodiment of the present invention, the predetermined second event data includes event data for a rhythm tone that is the same as that of the predetermined first event data. The event data is generated at a position that is different from the position of the first event data. In accordance with still another embodiment of the present invention, the predetermined second event data includes event data for a rhythm tone that is the same as that of the predetermined first event data. Also, the event data includes a tone having a magnitude different from that of the first event data. By the configuration described above, when automatic rhythm performance data including event data is read from the memory device, a predetermined second event data is added to the automatic rhythm performing data if a predetermined first event data is detected at a predetermined performance progression timing in the automatic rhythm performance data. As a result, a substantial degree of musical effect can be added to the original rhythm performance to an extent that it gives an impression that the original rhythm performance has been noticeably modified.

Other features and advantages of the invention will be apparent from the following detailed description, taken in conjunction with the accompanying drawings which illustrate, by way of example, various features of embodiments of the invention.

BRIEF DESCRIPTION OF THE DRAWINGS

A detailed description of embodiments of the invention will be made with reference to the accompanying drawings, wherein like numerals designate corresponding parts in the several figures.

DETAILED DESCRIPTION OF EMBODIMENTS

Figure 1:
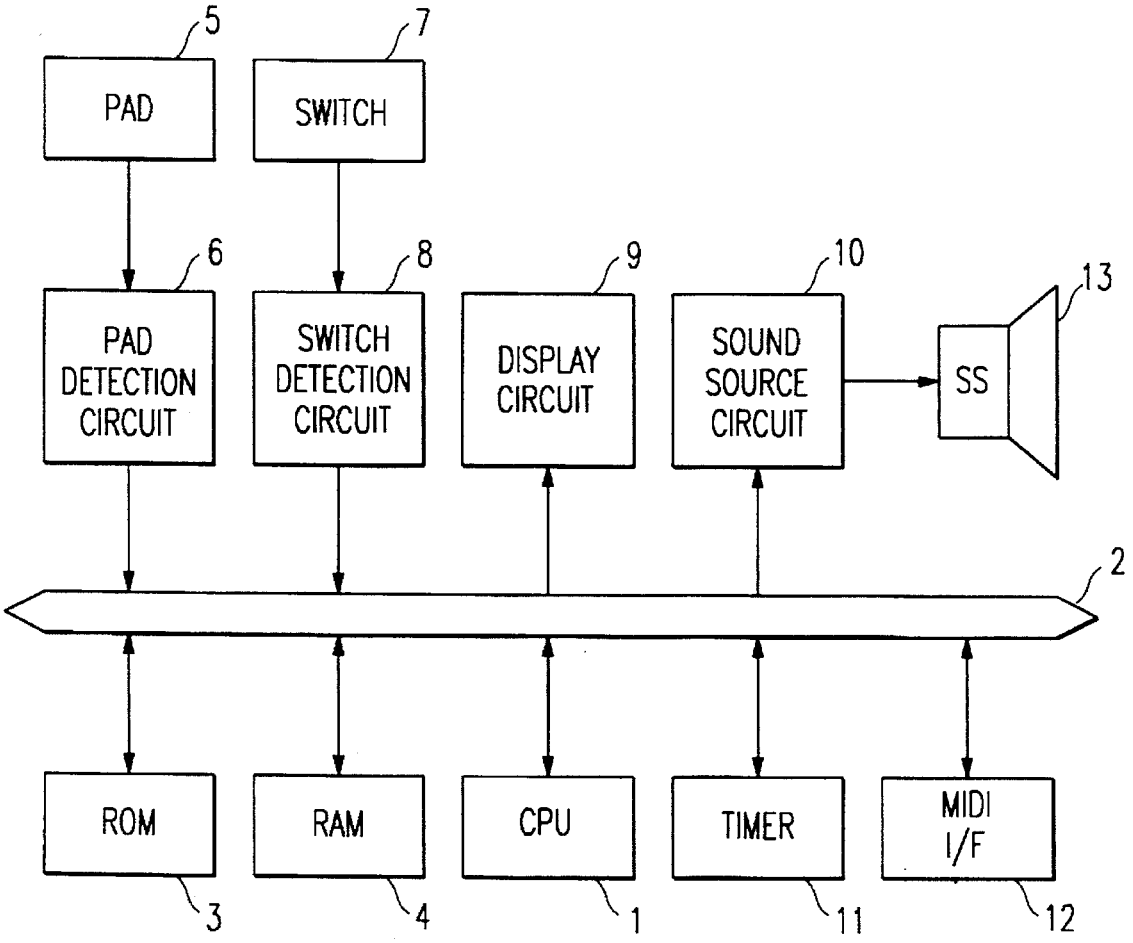
FIG. 1 is a block diagram of a hardware configuration in accordance with one embodiment of the present invention.
Figure 2:
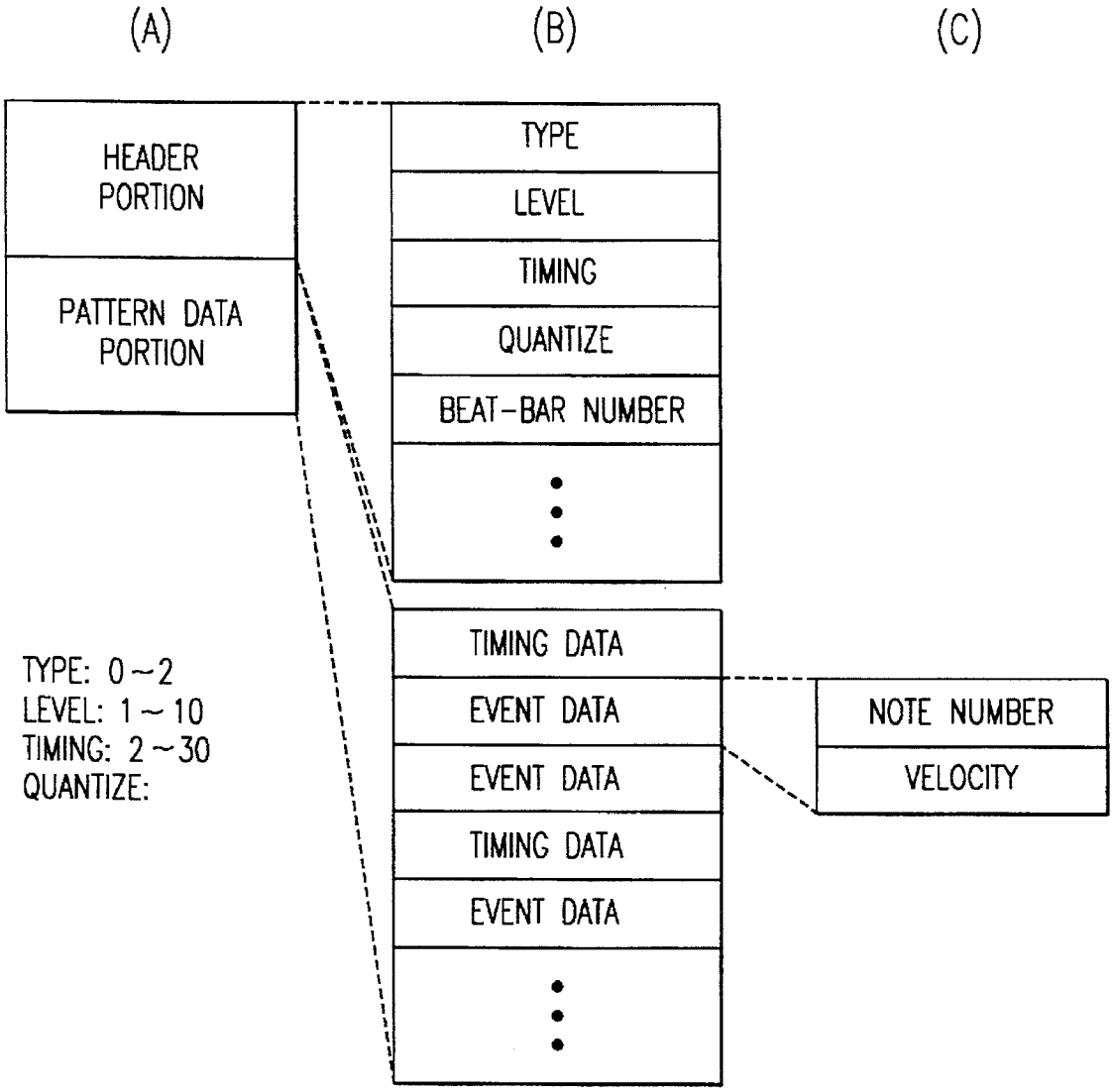
FIG. 2 shows a memory format for an automatic rhythm performance data in accordance with an embodiment of the present invention.

An automatic rhythm performing apparatus in accordance with one embodiment of the present invention is described below with reference to the accompanying drawings. FIG. 1 is a block diagram of a hardware configuration. A CPU (central processing unit) 1 controls the overall operation of the apparatus, and executes processes according to a control program stored in a ROM (read only memory) 3. The CPU 1 and other components are connected through a bus 2 for the transfer of various data. A RAM (random access memory) 4 is provided with work areas, such as, registers, flags and buffers for temporarily storing various data which are generated during the process by the CPU 1. The RAM 4 is also provided with work areas for storing automatic rhythm performance data, as shown in FIG. 2. A timer 11 provides an interrupt signal to the CPU 1, and generates an interrupt signal at a variable cycle determined by a specific tempo. An interrupt signal generation cycle that is determined by a specific tempo is, for example, a cycle at which 96 signals per a quarter note are generated, namely, a cycle equal to a three hundred and eighty fourth note. The CPU 1 reads out the automatic rhythm performance data stored in the RAM 4 in synchronism with the generation of the interrupt signals for automatic rhythm performance at a predetermined tempo.

In alternative embodiments, other signal processors, memory devices or the like may be used in place of the CPU 1, ROM 3 and RAM 4.

A pad device 5 has a plurality of hitting surfaces. When a player manipulates the pads, a pad detection circuit 6 detects the manipulation and provides an output signal, indicative of manipulation information, to the CPU 1 via the bus 2. The CPU 1 produces note (performance) data based on the pad manipulation information, and provides the data to a sound source circuit 10 through the bus 2. In one embodiment, the sound source circuit 10 produces, for example, a percussion instrument waveform signal based on the note data. The sound source circuit 10 may be formed by any one of several suitable sound source systems, such as, for example, a well known waveform memory read-out system, an FM (frequency modulation) system, a physical model simulation system or the like. The percussion instrument waveform signal produced at the sound source circuit 10 is provided to a sound system 13 to produce a percussion tone. In alternative embodiments, keys on a keyboard may be used either with or instead of the pad device 5.

A panel switch section 7 has a plurality of switches for designating various functions, such as a start and a stop of the automatic rhythm performance. The manipulation of the switches is detected by a switching detecting circuit 8. The detected switch manipulation information is supplied to the CPU 1 via the bus 2. The CPU 1 executes various functions in accordance with the supplied switch manipulation information. The reference numeral 9 represents a display circuit for displaying various data, such as, for example, data of the current operation status of the automatic rhythm performance apparatus or the like. The reference numeral 12 represents an MIDI interface (I/F) for outputting data such as note event data generated by the automatic rhythm performance process to an external sound source apparatus, or the like. The MIDI interface 12 can also receive note event data from an external electronic musical instrument in order to effect the sound source circuit 10, or input the automatic rhythm performance data. The MIDI interface 12 is also used for the transmission and reception of a synchronization signal for synchronizing with an external automatic performance apparatus (MIDI clock signal).

A format for the automatic rhythm performance data in accordance with one embodiment of the present invention will be described with reference to FIG. 2. Part (A) shows a general composition of the automatic rhythm performance data, which is composed of a header portion and a pattern data portion. The details of the header portion and the pattern data portion are shown in part (B).

The header portion stores various information relating to conditions of the automatic rhythm performance. TYPE is data that represents different types of effects that are to be added to the automatic rhythm performance. When TYPE is "0", no effect added. When TYPE is "1", a first effect is applied. The first effect, in accordance with embodiment, and causes a snappy tone to be added to the automatic rhythm performance at even beats, and also the timing of the automatic rhythm performance (for example, striking a snare drum) is advanced forward at even beats. When TYPE is "2", a second effect is applied. The second effect, in accordance with an embodiment, causes a snappy tone to be added to the automatic rhythm performance (for example, striking a snare drum and a hi-hat) at each second beat, where the velocity of the hi-hat is increased at down-beats in an eighth note or in a twelfth note (triplet), and the velocity at up-beats thereof is decreased. LEVEL is data which determines the velocity value, when adding the snappy tone of the snare drum or when changing the performance magnitude of the hi-hat. TIMING is data which indicates the amount of a time lag, when the timing for generating a note data at a predetermined beat timing is shifted forwardly. QUANTIZE is data that determines the timing at which the snappy tone of the snare drum is added, and the position at which the velocity of the hi-hat is changed. LEVEL may take a value, for example, in a range of between 1 and 10, and TIMING may take a value, for example, in a range of between 2 and 30. QUANTIZE may take a value that is preferably an eighth measure or a twelfth measure. In addition, the header stores data representing the number of beats and bars.

The pattern data portion stores the automatic rhythm performance data, for example, for one bar or for a plurality of bars, in a format including event data and timing data. As shown at (C) in FIG. 2, the event data includes a note number representative of the kind of a percussion instrument and a velocity representative of the magnitude of the tone generation of the percussion instrument. The timing data is indicative of separation time between one event data and another event data, and is defined by the clock number (the separation between two timer interrupts represents one clock). When a plurality of drum tones are to be generated at the same timing, a plurality of event data are stored in parallel with each other for that timing. It should be appreciated that the above data format is only one exemplary data format and that the automatic rhythm performance data may be stored in any one of other formats.

Figure 9:
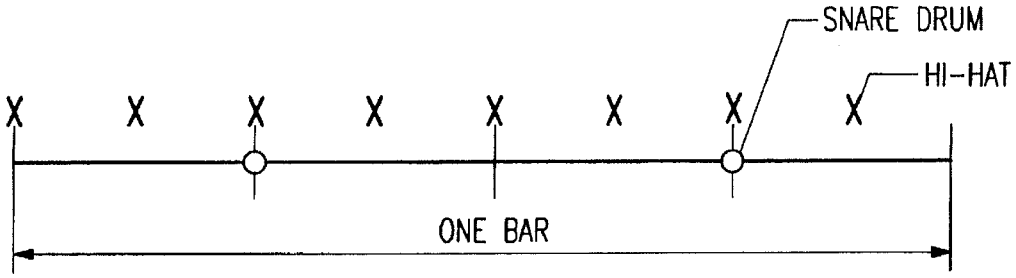
FIG. 9 shows an automatic rhythm performance pattern when TYPE is "0" in accordance with an embodiment of the present invention.
Figure 10:
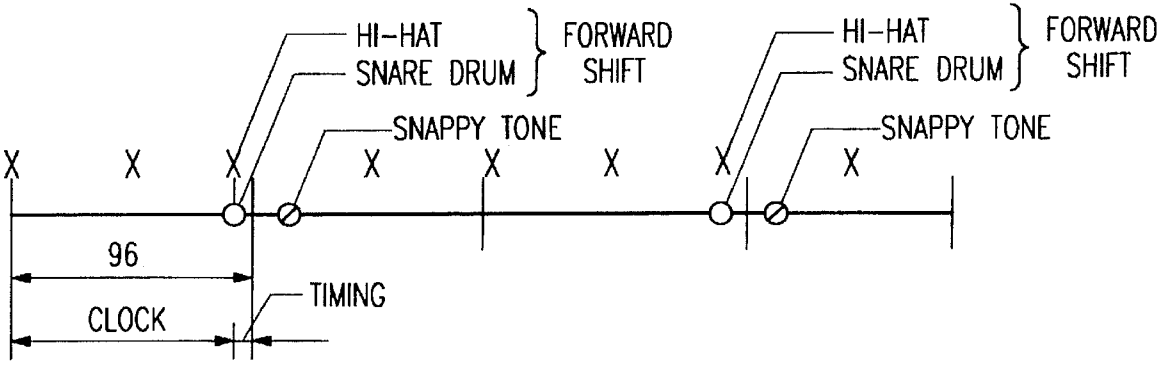
FIG. 10 shows an automatic rhythm performance pattern when TYPE is "1" in accordance with an embodiment of the present invention.
Figure 11:
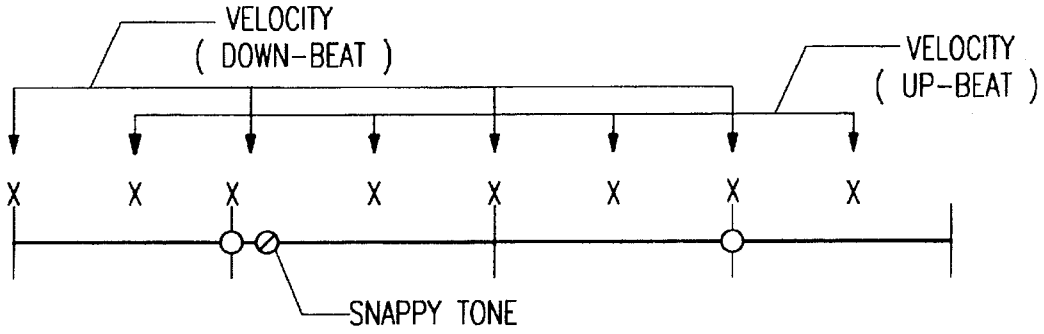
FIG. 11 shows an automatic rhythm performance pattern when TYPE is "2" in accordance an embodiment of the present invention.

Referring to FIGS. 9, 10 and 11, embodiments of the automatic rhythm performance using different values for TYPE are described. FIG. 9 shows an automatic rhythm performance when TYPE is "0" and no effect is added to the automatic rhythm performance. To simplify the explanation, FIG. 9 shows only event data of a snare drum (0) and a hi-hat (x) for one bar. Event data for the snare drum are present at the second beat and the fourth beat, and event data for the hi-hat are present at each eighth note cycle. FIG. 10 shows an automatic rhythm performance when TYPE is "1". In the embodiment shown in FIG. 10, an event of a snappy tone (ϕ) is added to each event of the snare drum at even beats (the second beat and the fourth beat). Also, the event timing of generating the snare drum and the hi-hat is shifted forward, as shown in FIG. 10. FIG. 11 shows the automatic rhythm performance when TYPE is "2", in which a snappy tone is added to an event of the snare drum at the second beat, the velocity of each event at down-beats is increased, and the velocity of each event at up-beats is decreased.

Figure 7:
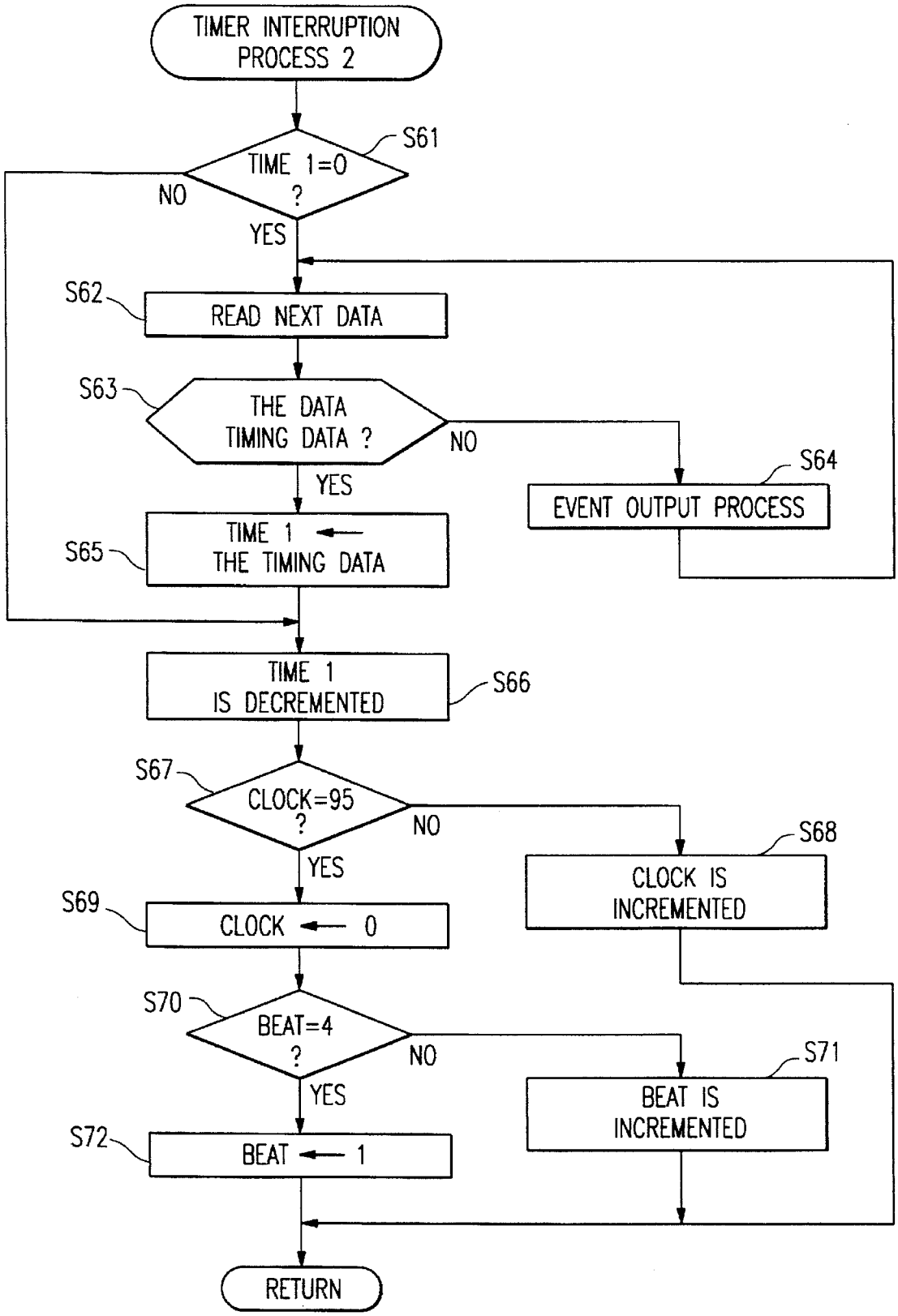
FIG. 7 is a flow chart showing a timer interrupt process in accordance with another embodiment of the present invention.
Figure 8:
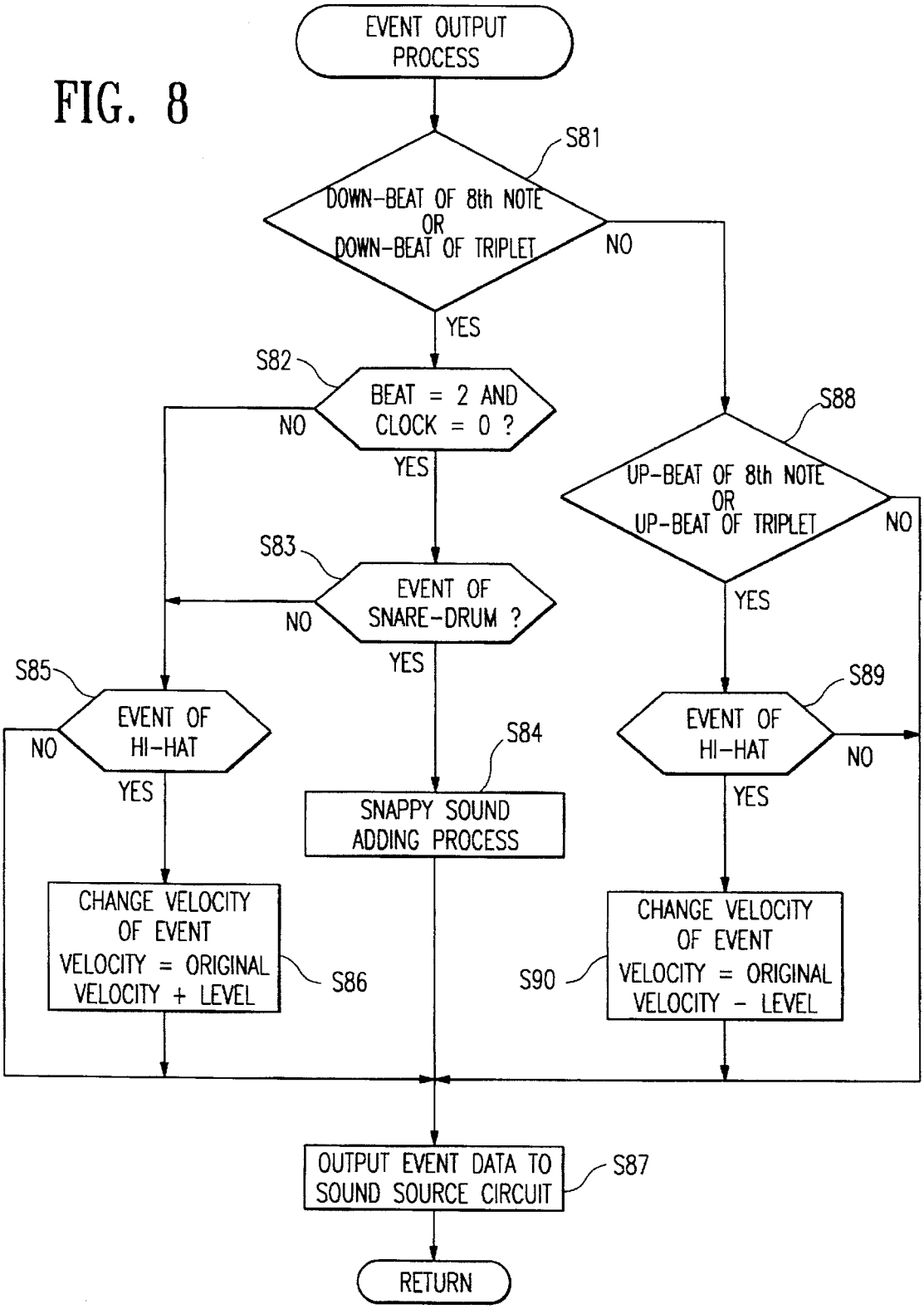
FIG. 8 is a flow chart showing an event output process in accordance with an embodiment of the present invention.

Hereunder, a process by the CPU 1 will be described with reference to the flow charts shown in FIGS. 3–8. The flow charts in FIGS. 3–8 show processes executed each time a timer interrupt signal is generated by the timer 11, such that a main routine process (not shown), which executes processes associated with the manipulation of the pads 5 and the panel switch 7, is interrupted, and a process for the automatic rhythm performance is executed. In the illustrated embodiments, different processes are executed depending upon the value of TYPE data in the header indicated at (B) in FIG. 2. Namely, when TYPE data is "1", the processes shown in FIGS. 3–6 are executed; and when the TYPE data is "2", the processes shown in FIGS. 5, 7 and 8 are executed. When the TYPE data is "0", a process which is similar to the conventional automatic rhythm performance process is executed, and therefore the description for such process is omitted. Processes for the operation of the switch panel 7 in connection with the start/stop of the automatic rhythm performance and the initial setting of registers by the switch are also well known, and therefore such description is omitted.

Figure 3:
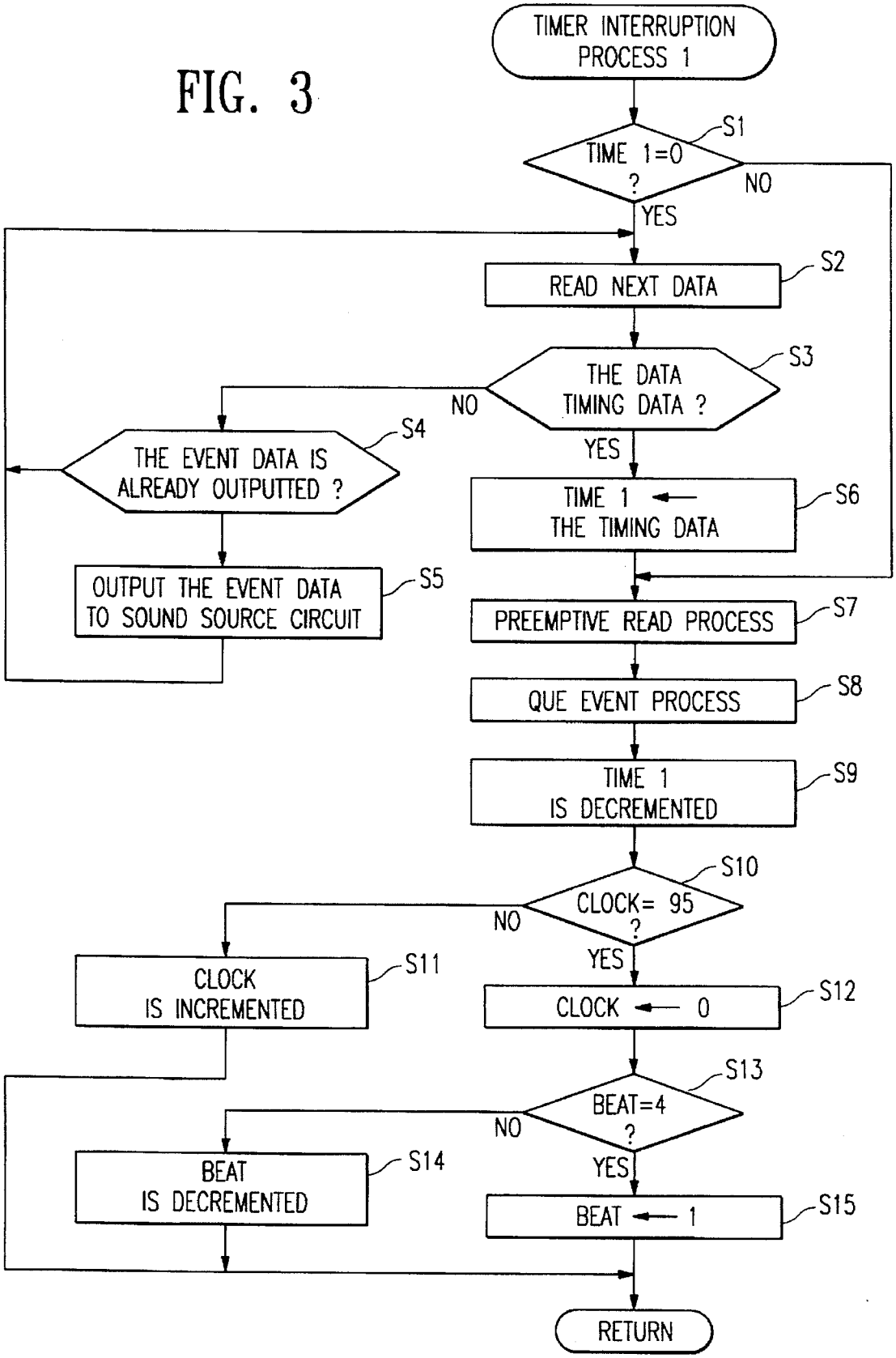
FIG. 3 is a flow chart showing a timer interrupt process in accordance with an embodiment of the present invention.

FIG. 3 shows a timer interrupt process 1. In step S1, a value stored in a register TIME 1 is checked to determine whether or not it equals "0". The register TIME 1 stores timing data of the pattern data portion shown at (B) in FIG. 2. TIME 1 is set in step S6, and decremented in step S9, as described later. When the automatic rhythm performance is started, first timing data is initially set (since the step being executed at the start of the automatic rhythm performance is well known as discussed above, the description thereof is omitted). The process is described hereunder, assuming that the value of TIME 1 is already set. In step S1, if the determination of TIME 1=0 is made, a time indicated by the timing data has elapsed, and the process proceeds to step S2 and to further steps in which event data is read out, and a process for setting the next timing data is executed. In step S2, data at the next address, which is subsequent to the address at which the timing data is stored, is read out. A determination is made in step S3 as to whether the read out data is timing data. If event data is stored next to the timing data, the determination in step S3 is "NO", and therefore the process proceeds to step S4. In step S4, a determination is made as to whether the read out event data has already been outputted to the sound source circuit 10. Ordinarily, the judgement is "NO", and therefore the process proceeds to step S5 in which the read out event data is outputted to the sound source circuit 10 such that a drum tone is generated. The judgement in step S4 is "YES", when data, which comes after the current timing (within a bar), has been read out by means of a preemptive read out process in step S7. These steps will be described below.

Next, the process returns to step S2, in which data in the next address is read out. When a plurality of event data are simultaneously generated at the same timing, another event data is read out. As a result, the determination is "NO" in step S3, and the above mentioned steps are repeated. If timing data has been read out, the read out timing data is stored in the register TIME 1 in step S6. Thereafter, if the determination is "NO" in step S1, the process proceeds to step S7, where the preemptive readout process of event data is executed. The details of step S7 are described with reference to FIG. 4.

Figure 4:
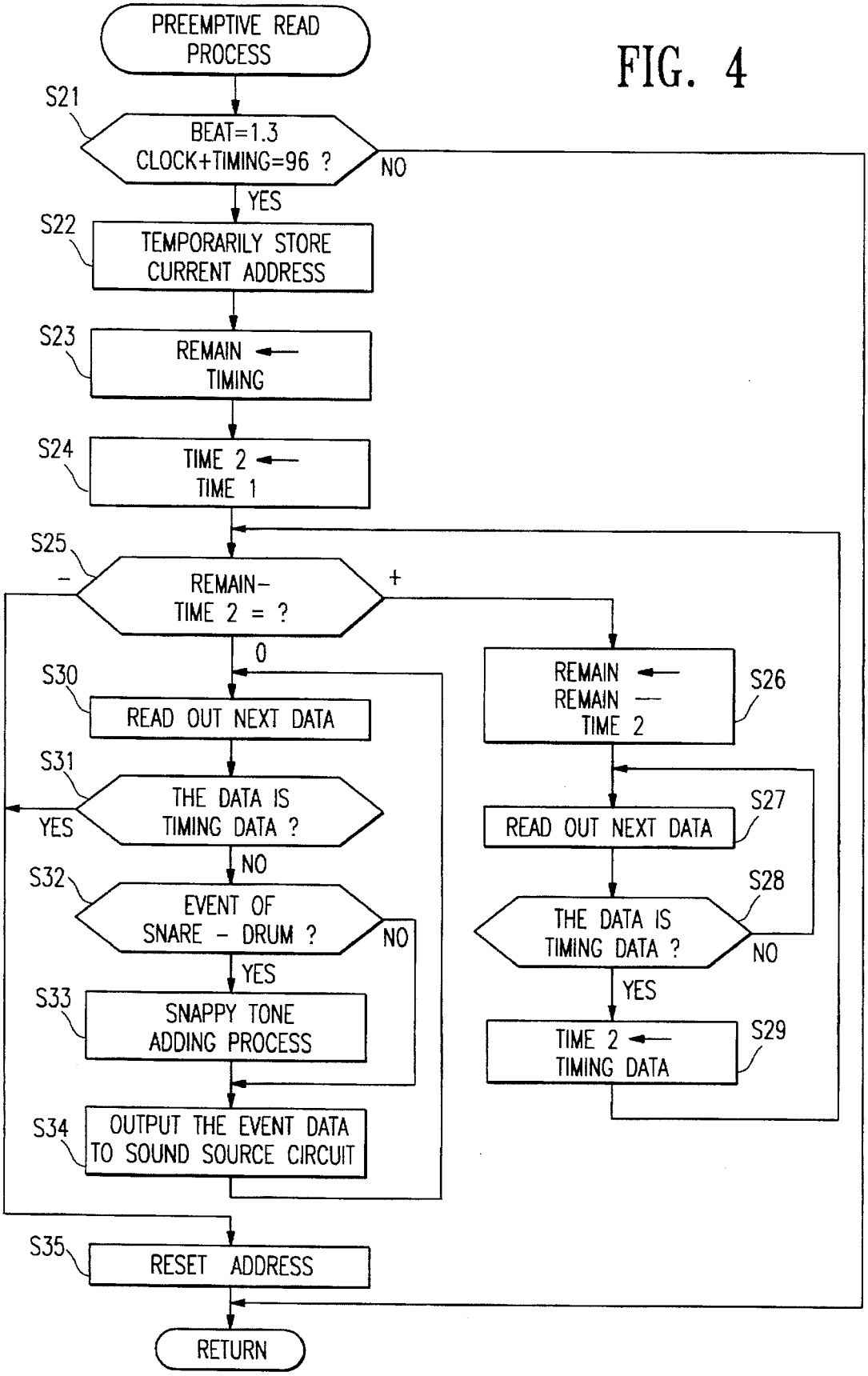
FIG. 4 is a flow chart showing a preemptive read out process in accordance with an embodiment of the present invention.
Figure 5:
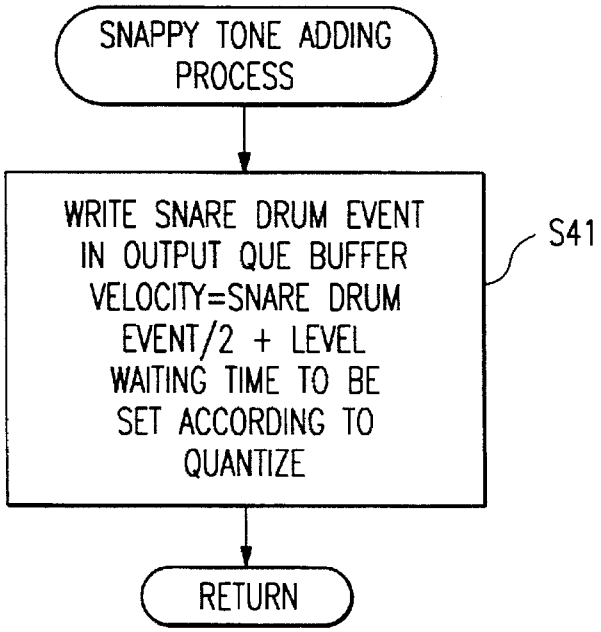
FIG. 5 is a flow chart showing a snappy sound adding process in accordance with an embodiment of the present invention.
Figure 6:
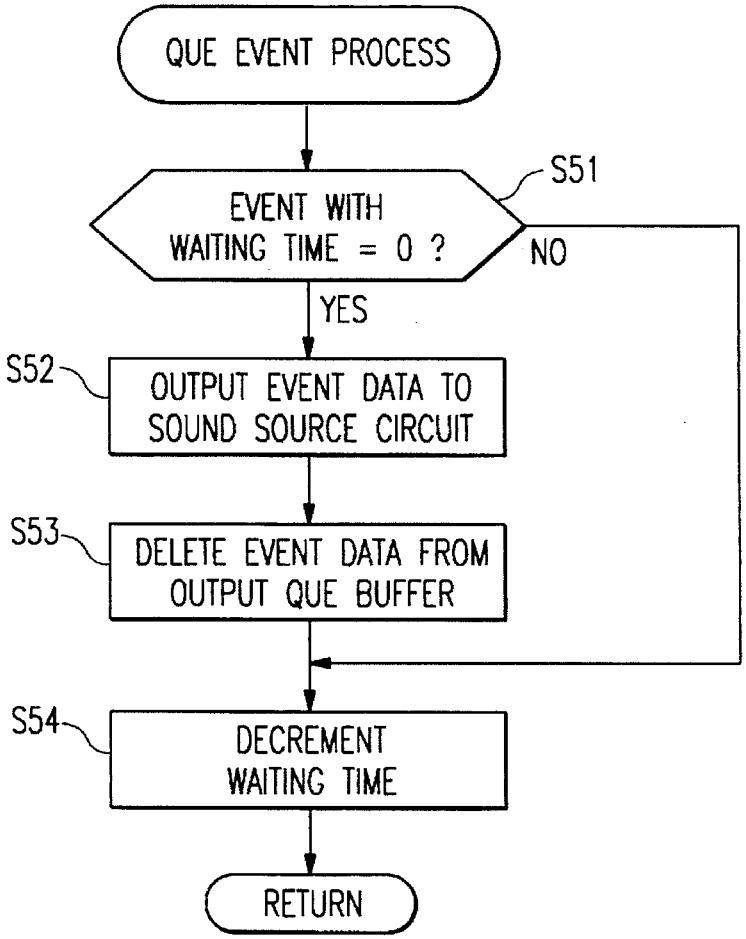
FIG. 6 is a flow chart showing a queuing event process in accordance with one embodiment of the present invention.

As shown in FIG. 4, a determination is made in step S21 as to whether the current value of BEAT is "1" or "3", and also a determination is made as to whether the value of "CLOCK+TIMING" is "96". Here, BEAT is a register which indicates the current beat position within a bar. Therefore, when the position of the currently progressing automatic rhythm performance is in the first beat, the register BEAT has a value of "1", and when it is in the second beat, the register BEAT has a value of "2". CLOCK is a register which indicates the position of progression in an interval between adjacent beats which is divided by 96. Namely, when the position of the progression coincides with the beat timing, the CLOCK register has a value of "0". At the next position, the CLOCK register has a value of "1", and still at the next position, the CLOCK register has a value of "2". The value of the CLOCK register is incremented by one at each timer interrupt process, until the CLOCK register value equals "95".

TIMING is information stored in the header portion at (B) of FIG. 2 as described above. TIMING has a value of 2 through 30. The TIMING information indicates an amount of a forward shift of the timing in the generation of the note event. At "CLOCK+TIMING="96, the current progression is at a position shifted forwardly from the next beat timing by an amount of TIMING. When the value of BEAT is 1 or 3, the current progression is in the first beat or in the third beat, respectively. In step S21, a determination is made as to whether the current progression is in the first beat or in the third beat, and also whether or not the current progression has reached a position shifted forwardly from the beat timing (namely, the second beat in the case where the current progression is in the first beat) by an amount of TIMING, or it has reached a position shifted forwardly from the beat timing (namely, the fourth beat in the case where the current progression is in the third beat) by an amount of TIMING.

The determination of "YES" in step S21 indicates the timing to execute a process of advancing forwardly the timing of striking at even beats in the above mentioned process of adding a snappy tone to a snare drum at even beats, and also advancing forwardly the timing of striking at even beats. In other words, the forward shifting process is achieved by preemptively reading data (which may otherwise be read out later) at the time when the forwardly shifted tone is to be generated. When the determination in step S21 is "YES", the process proceeds to step S22; and when the determination is "NO", the process returns to step 8 shown in FIG. 3.

In step S22, the current address value is temporarily stored in a temporary buffer that is provided within the RAM 4. In step S23, the timing value is stored in a register REMAIN. The register REMAIN stores a value to be used for checking how much timing remains until the next beat timing. This value is used in subsequent steps, such as step S25. In step S24, the value stored in the register TIME 1 is stored in a register TIME 2. The register TIME 2 stores timing data of the pattern data portion in a manner similar to TIME 1, and controls the timing until the next event data. The register TIME 2 is used solely for the preemptive read out process.

In step S25, a value obtained by subtracting the value of the register TIME 2 from the value of the register REMAIN is determined. If the value turns out to be a positive value (+), the process proceeds to step S26, where the next data is searched. In other words, when the result obtained by subtracting the value of the TIME 2 from the value of the register REMAIN is positive ("+"), the time remaining until the next event is shorter than the time remaining until the next beat timing. As a result, the next beat timing is assumed to be a timing which comes later than the next event.

In step S26, a value obtained by subtracting the value of the register TIME 2 from the value of the register REMAIN is stored in the register REMAIN, to thereby renew the value of the register REMAIN. In step S27, data in the next address is read out, and a determination is made as to whether the data read out in step S28 is timing data. Steps S27 and S28 are repeated until the timing data is read out. When the result of the determination is "YES", the timing data read out is stored in the register TIME 2 in step S29, and the process then proceeds to step S25. When the result of the determination is "0" in step S25, the time remaining until the next beat timing and the time remaining until the next event have the same length. To provide the event data present at this timing (i.e., at the beat timing) to the sound source circuit 10, the process proceeds to step S30 and subsequent steps.

In step S30, data at the next address is read out, and a determination is made in step S31 as to whether the data is timing data. Initially, the determination is "NO" since the data is event data. As a result, the process proceeds to step S32.

In step S32, a determination is made as to whether or not the note number of the read out event data coincides with the note number of the snare drum. If they coincide with each other, a process of adding a snappy tone to the snare drum tone is executed in step S33.

FIG. 5 shows the process of adding a snappy tone to the snare drum tone executed in step S33. As shown in FIG. 5, an event of the snare drum is written in an output queue event buffer in step S41. The output queue event buffer is provided within the RAM 4, and is used as a buffer for generating a desired event at a time which occurs later than the current timing. The output queue event buffer stores an event data together with waiting time period information representative of an amount of delay between the current timing and the timing at which the event is to be generated. The waiting time period information is decremented at each timer interrupt process. When the waiting time period information reaches "0", the event is outputted, to thereby achieve a function of the delaying tone generation. Then, the velocity value of the event data is determined to be the original velocity value of the snare drum/2 +LEVEL. By this formula, the velocity value of the snappy tone is determined so that the velocity of the snappy tone is smaller than the original velocity of the snare drum, and is variable in response to the value of LEVEL. It should be appreciated that the velocity value of the snappy tone may be determined by any one of several other methods. For example, the velocity value of the snappy tone may be a fixed value. Further, the waiting time may be set in accordance with the value of QUANTIZE. For example, if QUANTIZE has an eighth note, the waiting time may be set at a value which delays by an amount of the waiting time=72 (corresponding to a time position which is delayed by a dotted-eighth note from the original event timing of the snare drum). Also, if QUANTIZE has a twelfth note (a triplet rhythm), the waiting time may be set at a value which delays by an amount of the waiting time=64 (corresponding to a time position which is delayed by two dotted-twelfth notes from the original event timing of the snare drum). It should be appreciated that the waiting timing may be set at any other values.

After step S33 (FIG. 4), the process proceeds to step S34 where event data, which is the event of the snare drum read out in step S30, is outputted to the sound source circuit 10. On the other hand, if the determination is "NO" in step S32, the process in step S33 is skipped, and the read out event data is provided to the sound source circuit 10 in step S34. As a result, tones of the event data present in the second beat and the fourth beat are generated in advance by an amount of the value set in the register TIMING. Thereafter, the process returns to step S30, and the next data is read out. The above mentioned steps are repeated until a timing data is read out. When the determination is "YES" in step S31, the temporarily stored address value is reset in step S35, and the process returns.

If, in step S25, a value obtained by subtracting the value of the register TIME 2 from the value of the register REMAIN is a negative value ("–"), the time remaining until the next event is longer than the time remaining until the next beat timing. This means that no event is present at the next beat timing. Therefore, since there is no tone of an event to be generated, the process proceeds directly to step S35, where the address value is reset and the process returns to step S8, as shown in FIG. 3.

Referring back to FIG. 3, after step S7, the process proceeds to step S8, where a queue event process is executed. The queue event process is shown in detail in FIG. 6. In step S51, event data stored in the output queue event buffer are searched for one event data having a waiting time value of "0". If found, the event data are outputted to the sound source circuit 10 in step S52, and the event data are erased from the output queue event buffer in step S53. If the determination is "NO" in step S51, the waiting timing value stored in the output queue event buffer is decremented. By this process, the snappy tone set in step S41 in the steps shown in FIG. 5 is generated at a timing delayed by an amount of the waiting time from the original tone generation of the snare drum.

Referring back to FIG. 3, after step S8, the process proceeds to step S9 where the value of the register TIME 1 is decremented, and the process proceeds to step S10. In the steps after step S10, the values of CLOCK and BEAT are renewed. First, a determination is made as to whether the value of CLOCK is "95". If the value of CLOCK is not "95", the value of CLOCK is incremented in step S11. If the value of CLOCK is "95", the process reaches a position of the next beat. Therefore, in step S12, the value of CLOCK is changed to "0", and in step S12, a determination is made as to whether the value of BEAT is "4". If the value of BEAT is not "4", the value of BEAT is incremented. If the value of BEAT is "4", the value of BEAT is set to "1" in step S15. Incidentally, in step S2, when the read out data reaches the last data of the automatic rhythm performance data, the process returns to the head portion of the automatic rhythm performance data, and the read out process is repeated. The automatic rhythm performance data is formed so that the step of returning to its head portion occurs at a cut position between adjacent bars. As a result, the automatic rhythm performance pattern can be repeated for each bar. The above described process is executed when TYPE is "1" in which a snappy tone is added to a snare drum at even beats, and also the timing of striking is advanced forward at even beats.

A timer interrupt process 2 which takes place when TYPE is "2" is described with reference to FIGS. 5, 7 and 8. Referring to FIG. 7, in step S61, a determination is made as to whether the value of the register TIME 1 is "0". If the result is "YES", an event data should be read out, and consequently data at the next address is read out in step S62. In step S63, a determination is made as to whether the data read out is timing data. In a manner similar to the process in step S3, the result of the determination is initially "NO" in step S63, and therefore the process proceeds to step S64.

The event output process in step S64 is described in detail with reference to FIG. 8. Initially, a determination is made in step S81 as to whether the currently progressing timing is a timing at the down-beat of an eighth note (when QUANTIZE is an eighth note), or a timing of the down-beat of a triplet (when QUANTIZE is a twelfth note). More particularly, the currently progressing timing is determined based on the values of BEAT and CLOCK. More specifically, when "BEAT=1, CLOCK=0", "BEAT=2, CLOCK=0", "BEAT=3, CLOCK=0", and "BEAT=4, CLOCK=0", the determination is "YES" in step S81 (for both occasions when QUANTIZE is an eighth note and a twelfth note). Then, the process proceeds to step S82 to determine if the condition "BEAT =2, and CLOCK=0" is met, namely a determination is made as to whether the timing is at the second beat. If "YES", a determination is made in step S83 as to whether the read out event data is an event of the snare drum. If "YES", the above described process of adding a snappy tone (FIG. 5) is executed in step S84 such that a snappy tone is added to the tone of the snare drum at the second beat. The event data, which, in this case, is an event of the snare drum, is provided to the sound source circuit 10 in step S87.

On the other hand, if the determination is "NO" in step S82 or in step S83, a determination is made as to whether the read out event data is an event of the hi-hat. If the determination is "YES", the velocity value of the event is converted to "the original velocity value +LEVEL" in step 86. In step S87, event data, which is an event of the hi-hat in this case, is outputted to the sound source circuit 10. In this manner, when the currently progressing timing is a timing at the down-beat of an eighth note, or a timing at the down-beat of a triplet, the velocity value for the event of the hi-hat is increased. In step S85, if the determination is "NO" the process proceeds directly to step S87 to output the event data to the sound source circuit 10.

If the determination in the step S81 is "NO" the process proceeds to step S88, where a determination is made as to whether the currently progressing timing is a timing at the up-beat of an eighth note (when QUANTIZE is an eighth note), or a timing of the up-beat of a triplet (when QUANTIZE is a twelfth note). More particularly, the currently progressing timing is determined based on the values of BEAT and CLOCK. More specifically, when "BEAT=1, CLOCK=48""BEAT=2, CLOCK=48""BEAT=3, CLOCK =48", and "BEAT=4, CLOCK=48"(when the QUANTIZE is an eighth note), or when "BEAT=1, CLOCK=64""BEAT=2, CLOCK=64", "BEAT=3, CLOCK=64", and "BEAT=4, CLOCK=64"(when QUANTIZE is a twelfth note), the determination in step S88 is "YES." The process then proceeds to step S89, where a determination is made as to whether the read out event data is an event of the hi-hat. If the determination is "YES", the velocity value of the event is converted to the original velocity value—LEVEL in step S90. Also, the event data, which in this case is an event of the hi-hat, is outputted to the sound source circuit 10. In this manner, when the currently progressing timing is a timing at the ! 0 up-beat of an eighth note, or a timing at the up-beat of a triplet, the velocity value for the event of the hi-hat is decreased. In step S88 or step S89, if the determination is "NO", the process proceeds directly to step S87 to output the event data to the sound source circuit 10. 15 Referring back to FIG. 7, after the output of the event data is completed, and if the determination in step S63 is "YES", the process proceeds to step 65 where the read out timing data is stored in the register TIME 1. Thereafter, the process proceeds to step S66 in which the value of the register TIME 1 is decremented. On the other hand, if the determination is "NO" in step S61, the process proceeds to step S66. After the process in step S66, step S67 is executed. Since the process in step S67 through step S72 is the same as the process executed in step S10 through step S15 described above with reference to FIG. 3, the description is omitted. It is noted that when the read out data reaches the last data of the automatic rhythm performance data in step S62, the process returns to the head portion of the automatic rhythm performance data, and the reading out process is continuously repeated. The above process takes place when TYPE is "2", and a snappy tone is added to a snare drum at each second beat, and the velocity of a hi-hat is increased at down-beats in an eighth note or in a twelfth note (triplet), and the velocity at up-beats thereof is decreased.

Two embodiments have been described herein above, namely the first effect embodiment in which a snappy tone is added to a snare drum at even beats, and also the timing of striking is advanced forward at even beats, and the second effect embodiment in which a snappy tone is added to a snare drum at each second beat, and the velocity of a hi-hat is increased at down-beats in an eighth note or in a twelfth note (triplet), and the velocity at up-beats thereof is decreased. However, it should be appreciated that embodiments of the present invention may be used to provide effects other than those described above to modify the performance data.

Also, in the above described embodiments, predetermined event data (snappy tone) is added while the performance is executed as the automatic rhythm performance data is being read out. It should be appreciated that automatic rhythm performance data with a predetermined event data added thereto may be produced prior to the performance, and this then may be read out to execute the automatic rhythm performance. Furthermore, event data to be added is not limited to event data of the snare drum.

In the embodiments described above, information (TYPE) indicative of the types of the effect to be added is stored in the automatic rhythm performance data (in the header portion). However, instead of storing such information in the automatic rhythm performance data, a panel switch or the like may be used to designate what type of effect is to be added. Also, in a similar manner, a panel switch may be used to designate information about various parameters for effects to be added (e.g., TIMING, LEVEL, QUANTIZE). Furthermore, on/off of the effect, types, various parameters, etc. may be stored as event data in an automatic performance data (for example, in pattern sequence data to be used when data for a music piece is produced by combining automatic rhythm pattern data.)

While the description above refers to particular embodiments of the present invention, it will be understood that many modifications may be made without departing from the spirit thereof. The accompanying claims are intended to cover such modifications as would fall within the true scope and spirit of the present invention.

The presently disclosed embodiments are therefore to be considered in all respects as illustrative and not restrictive, the scope of the invention being indicated by the appended claims, rather than the foregoing description, and all changes which come within the meaning and range of equivalency of the claims are therefore intended to be embraced therein.

What is claimed is:

1. An automatic rhythm performing apparatus comprising:

a memory device that stores automatic rhythm performing data including event data;

a reading device that reads out the automatic rhythm performing data including the event data from the memory device;

a detecting device that detects a predetermined first selection of event data at a predetermined performance progression timing in the automatic rhythm performing data; and an adding device, responsive to a detection by the detecting device, for adding a predetermined second selection of event data to the first selection of event data of the automatic rhythm performing data.

2. An automatic rhythm performing apparatus according to claim 1, wherein the predetermined second selection of event data includes a rhythm tone which is the same as that of the predetermined first selection of event data, wherein the second selection of event data is presented at a timing different from that of the first selection of event data.

3. An automatic rhythm performing apparatus according to claim 2, wherein the predetermined second selection of event data includes a rhythm tone which is the same as that of the predetermined first selection of event data, wherein the second selection of event data also includes a tone having a magnitude different from that of the first selection of event data.

4. An automatic rhythm performing apparatus according to claim 1, wherein the predetermined first selection of event data at the predetermined performance progression timing includes event data representative of a snare drum tone at an even beat.

5. An automatic rhythm performing apparatus according to claim 1, wherein the predetermined first selection of event data at the predetermined performance progression timing includes event data representative of a snare drum tone at a second beat.

6. An automatic rhythm performing apparatus according to claim 1, further including means for modifying the tone generation timing of event data at a predetermined performance progression timing.

7. An automatic rhythm performing apparatus according to claim 1, further including means for modifying the amplitude of event data at a predetermined performance progression timing.

8. An automatic rhythm performing apparatus according to claim 1, further including means for setting a position at which the second selection of event data to be added is located.

9. An automatic rhythm performing apparatus according to claim 1, further including means for setting the tone generation amplitude of the second selection of event data to be added.

10. An automatic rhythm performing apparatus according to claim 8, wherein the automatic rhythm performance data includes a header portion and a pattern data portion, the header portion storing information for setting the position at which the second selection of event data to be added is located.

11. An automatic rhythm performing apparatus according to claim 9, wherein the automatic rhythm performance data includes a header portion and a pattern data portion, the header portion storing information for setting the tone generation amplitude of the second selection of event data to be added.

12. An automatic rhythm performing apparatus according to claim 1, further including means for determining whether the adding device is activated.

13. An automatic rhythm performing apparatus according to claim 1, wherein the second selection of event data added by the adding device is located at a later time position than the first selection of event data.

14. An automatic rhythm performing apparatus according to claim 1, wherein the second selection of event data added by the adding device has a tone generation amplitude smaller than that of the first selection of event data.

15. An automatic rhythm performing apparatus according to claim 6, wherein the means for modifying moves the tone generation timing of event data which is present at even beats forward.

16. An automatic rhythm performing apparatus according to claim 7, wherein the means for modifying increases the amplitude of predetermined event data which is present at down-beats and decreases the amplitude of the predetermined event data which is present at up-beats.

17. A method of automatic rhythm performing, the method comprising the steps of:

storing automatic rhythm performing data including event data;

reading out the automatic rhythm performing data including the event data;

detecting a predetermined first selection of event data at a predetermined performance progression timing in the automatic rhythm performing data; and adding, in response to a detection, predetermined second selection of event data to the first selection of event data of the automatic rhythm performing data.

18. A method according to claim 17, wherein the predetermined second selection of event data includes a rhythm tone which is the same as that of the predetermined first selection of event data, wherein the second selection of event data is presented at a timing different from that of the first selection of event data.

19. A method according to claim 18, wherein the predetermined second selection of event data includes a rhythm tone which is the same as that of the predetermined first selection of event data, and wherein the second selection of event data also includes a tone having a magnitude different from that of the first selection of event data.

20. A method according to claim 17, wherein the predetermined first selection of event data at the predetermined performance progression timing includes event data representative of a snare drum tone at an even beat.

21. A method according to claim 20, wherein the predetermined first selection of event data at the predetermined performance progression timing includes event data representative of a snare drum tone at a second beat.

22. A method according to claim 17, further including the step of modifying the tone generation timing of event data at a predetermined performance progression timing.

23. A method according to claim 17, further including the step of modifying the amplitude of event data at a predetermined performance progression timing.

24. A method according to claim 17, further including the step of setting a position at which the second selection of event data to be added is located.

25. A method according to claim 17, further including the step of setting the tone generation amplitude of the second selection of event data to be added.

26. A method according to claim 24, wherein the automatic rhythm performance data includes a header portion and a pattern data portion, the header portion storing information for setting the position at which the second selection of event data to be added is located.

27. A method according to claim 25, wherein the automatic rhythm performance data includes a header portion and a pattern data portion, the header portion storing information for setting the tone generation amplitude of the second selection of event data to be added.

28. A method according to claim 17, further including the step of determining whether to perform the step of adding.

29. A method according to claim 17, wherein the added second selection of event data is located at a later time position than the first selection of event data.

30. A method according to claim 17, wherein the added second selection of event data has a tone generation amplitude smaller than that of the first selection of event data.

31. An automatic rhythm performing apparatus comprising:

a memory device that stores automatic rhythm performing data that includes a first selection of event data, the memory device also storing a second selection of event data to be read out separately from the automatic rhythm performing data;

a reading device that reads out the automatic rhythm performing data including the first selection of event data from the memory device;

a detecting device that detects the first selection of event data at a predetermined performance progression timing in the automatic rhythm performing data; and an adding device, responsive to a detection by the detecting device, for reading out the second selection of event data, and producing a tone representative of the second selection of event data at a timing different from the predetermined performance progression timing by adding the first selection of event data together with the second selection of event data.

32. An automatic rhythm performing apparatus according to claim 31, wherein the second selection of event data is generated at a timing later than the predetermined performance progression timing.

33. An automatic rhythm performing apparatus according to claim 31, wherein the second selection of event data includes a rhythm tone which is the same as that of the first selection of event data, and wherein the second selection of event data is generated at a timing later than the predetermined performance progression timing.

34. An automatic rhythm performing apparatus according to claim 31, wherein the second selection of event data includes a rhythm tone which is the same as that of the first selection of event data, and wherein the second selection of event data also includes a tone having a magnitude different from that of the first selection of event data.

35. An automatic rhythm performing apparatus according to claim 31, further including a sound source circuit to generate a tone representative of event data, and wherein the first selection of event data is not produced at the predetermined performance progression timing if the first selection of event data has already been outputted to the sound source circuit before the predetermined performance progression timing, and the second selection of event data is produced later than the first selection of event data outputted before the predetermined performance progression timing.

36. An automatic rhythm performing apparatus comprising:

a memory device that stores automatic rhythm performing data that includes event data;

a reading device that reads out the automatic rhythm performing data including the event data from the memory device;

a selector that selects an effect from among a plurality of effects to be added to the automatic rhythm performing data;

a controlling device responsive to the effect selected by the selector that, when detecting a predetermined first selection of event data at a predetermined performance progression timing in the automatic rhythm performing data, adds a predetermined second selection of event data to the automatic rhythm performing data, and that moves the tone generation timing of event data which is present at predetermined beats forward; and a generating device that generates automatic rhythm tones based on the automatic rhythm performing data read out by the reading device and the predetermined second selection of event data provided by the controlling device.

* * * * *